United States Patent [19]

Sandifer

[11] 3,977,085

[45] Aug. 31, 1976

[54] PENDULUM TOY

[76] Inventor: Robert L. Sandifer, 739 N. Dougherty, Wichita, Kans. 67212

[22] Filed: Oct. 20, 1975

[21] Appl. No.: 623,728

[52] U.S. Cl. ..... 33/27 L

[51] Int. Cl.[2] ..... B43L 11/00

[58] Field of Search ..... 33/18 R, 27 R, 27 L, 33/30 R, 24 B

[56] References Cited

UNITED STATES PATENTS

| | | | |
|---|---|---|---|
| 1,869,951 | 8/1932 | Worthington | 33/27 L |
| 3,143,807 | 8/1964 | Christie | 33/27 L |
| 3,324,556 | 6/1967 | Everett | 33/27 L |
| 3,384,966 | 5/1968 | Lias | 33/27 L |
| 3,494,037 | 2/1970 | Arber | 33/27 L |
| 3,496,641 | 2/1970 | Mills | 33/27 L |
| 3,590,488 | 7/1971 | Padowicz | 33/27 L |

*Primary Examiner*—Charles E. Phillips

*Attorney, Agent, or Firm*—John H. Widdowson; Edwin H. Crabtree

[57] ABSTRACT

A pendulum toy using a drawing pen, for making a variety of arcuate designs such as curves, spirals, and cycloids on a work sheet positioned on the surface of the top of a table.

11 Claims, 7 Drawing Figures

PENDULUM TOY

BACKGROUND OF THE INVENTION

This invention relates generally to gravity driven toys, and more particularly, but not by way of limitation, to a pendulum toy using a drawing pen, pencil or the like making a variety of arcuate designs such as curves, spirals and cycloids.

Heretofore pendulum toys using two pendulum rods co-acting with connecting rods attached to a drawing pen have been complex in design and bulky in structure. One prior art pendulum toy requires a supporting member with a clamp for clamping the member to the top of a table. The clamp holds the toy in place and prevents movement of the supporting member while the toy is in operation. Also the supporting member is extended over the edge of the table to allow room for the pivoting of the pendulum rods.

Another prior art pendulum toy avoids the use of a clamp and supporting member by using a hollow container filled with water to hold the toy on the table during the toy's operation. This toy further requires an elevated platform mounted on top of the water filled container for a drawing surface. The platform requires slots in the edge of the platform for pivoting the pendulum rods.

The subject invention eliminates the above mentioned design and structural problems of the pendulum toy and greatly simplifies the required elements used in a pendulum toy for drawing a variety of designs. None of the prior art pendulum toys disclose the novel combination used in constructing the pendulum toy as herein disclosed.

SUMMARY OF THE INVENTION

The subject invention is readily adaptable to any horizontal surface such as the top of a table or desk where a work sheet is placed on the surface of the table.

The pendulum toy does not need to be clamped to the table nor does it require a special supporting member clamped to the table and extending over the edge of the table. Also the toy does not require slots in the edge of the table or a slotted platform to provide room for pivoting the pendulum rods.

The subject pendulum toy is light in weight, portable, unique in design, attractive in appearance, durable in structure, and easily set up and taken down.

The pendulum toy includes vertically positioned pendulum rods with an annular center portion which allows pendulum weights attached to the rods to be placed directly below stirrups placed on the edge of the table and used for pivoting the pendulum rod. The pendulum rods are pivotably attached to horizontally balanced connecting rods by universal joints. The connecting rods are attached to a pen holder holding a drawing pen thereon. The connecting rods further include counterweights for balancing the weight on the tip of the pen to provide either heavy or light lines in the drawing of the designs. The counterweight also provides a balancing adjustment by taking weight off of the tip of the pen, thereby reducing the amount of friction on the tip of the pen as it draws the designs and producing a longer design drawing time.

The stirrups used for pivoting the pendulum rods further include a stirrup base containing rubber grips for gripping the surface of the table top. Through the use of the rubber grips and the annular center portion of the pendulum rods allowing the pendulum weights to be positioned directly below the stirrups, the movement of the toy is prevented during the drawing of the designs.

The advantages and objects of the invention will become evident from the following detailed description when read in conjunction with the accompanying drawings which illustrate the preferred embodiments of the invention.

DETAILED DESCRIPTION OF THE DRAWINGS

Figures 1, 7:
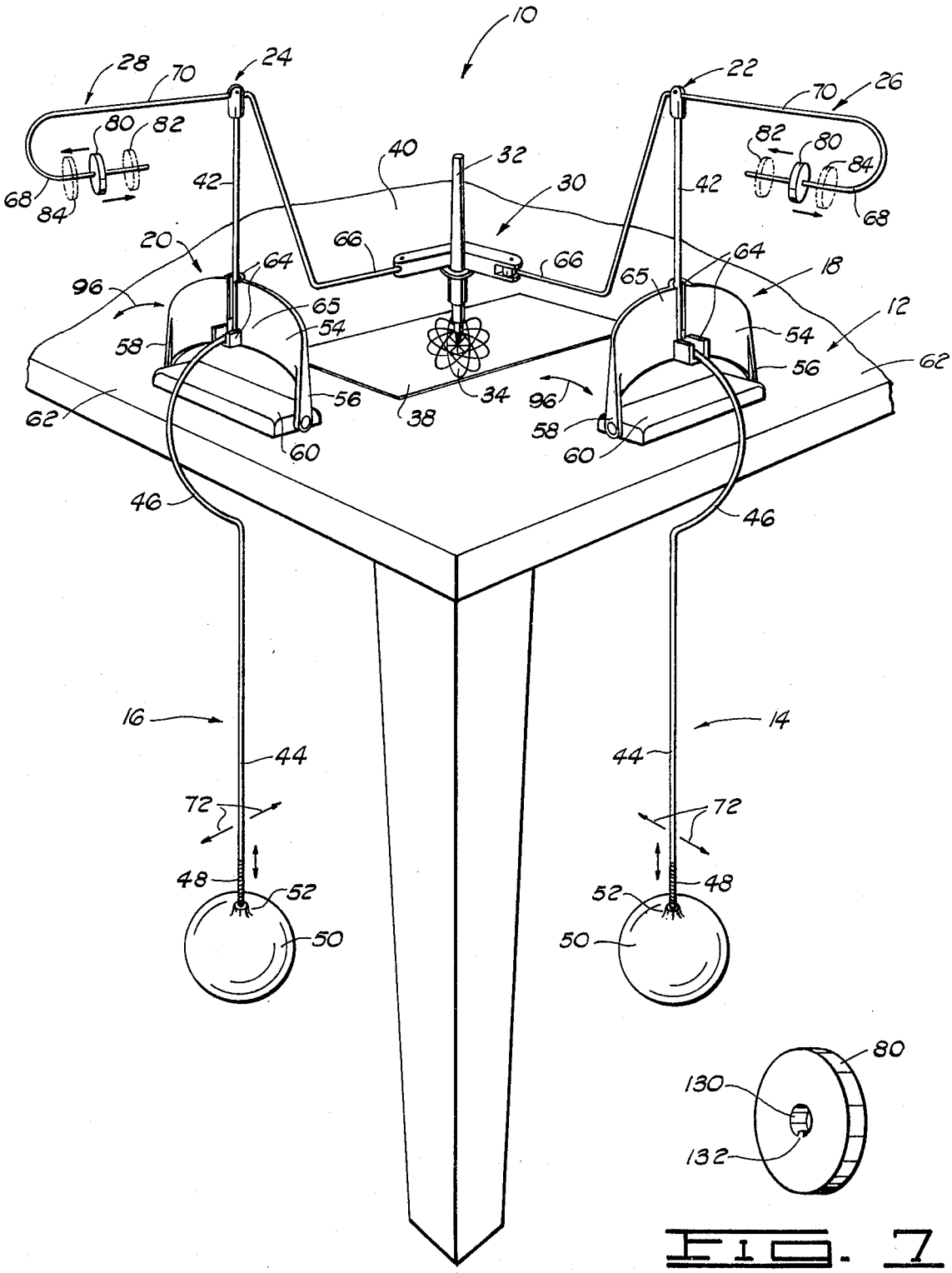
FIG. 1 is a perspective view of the pendulum toy mounted on the top of a table.
FIG. 7 is a perspective view of the adjustable counterweight.

In FIG. 1 the pendulum toy is designated by general reference number 10. The toy 10 is mounted on a table 12 and includes a first pendulum rod 14 and a second pendulum rod 16, and first stirrup 18 and a second stirrup 20, a first universal joint 22 and a second universal joint 24, a first connecting rod 26 and a second connecting rod 28 and a pen holder 30. The pen holder 30 is shown holding a pen 32 for drawing a design 34 on a work sheet 38 resting on the horizontal surface 40 of the top of a table 12.

The first pendulum rod 14 and second pendulum rod 16 include a vertically positioned first end portion 42, a second end portion 44 and a center portion 46. The first end portion 42 of the pendulum rods 14 and 16 are pivotally attached to the universal joints 22 and 24. The second end portion 44 of the pendulum rods 14 and 16 includes a threaded end 48 for threadably engaging a pendulum weight shown as a weighted ball 50 with a threaded cap 52 integrally attached to the ball 50. The ball 50 is water tight and can be filled with water or optionally can be filled with sand, or any other material to provide the necessary weight to operate the toy 10.

The center portion 46 of the pendulum rods 14 and 16 is annular in shape and is disposed around the edge portion 62 of the table 12. The center portion 46 of the pendulum rods 14 and 16 clears the edge of the table enough to allow the pendulum rods to swing freely in a vertical plane in the direction shown by arrows 72. It should be noted by having the annular shape of the center portion 46, the first end portion 42 and the second end portion 44 of the pendulum rods 14 and 16 can be disposed above and below the edge portion 62 of the table 12 is a vertical position. Also the weighted balls 50 are suspended directly below the stirrups 18 and 20 to provide a downward force to aid in holding the stirrups 18 and 20 in place on the table 12.

The first and second pendulum rod pivot means or stirrups 18 and 20 include a stirrup frame 54 having end portions 56 and 58 pivotally attached to a stirrup base 60. The stirrup base 60 is engagingly received on the surface 40 of the table 12 at the table's edge portion 62. The pendulum rods 14 and 16 are attached to the first stirrup 18 and second stirrup 20 in an L-shaped channel 64 mounted in a center portion 65 of the stirrup frame 54.

The first and second connecting rods 26 and 28 include an inclined angular shaped first end portion 66, a U-shaped second end portion 68, and a center portion 70. The center portion 70 of the connecting rods 26 and 28 is pivotally attached to and horizontally balanced on the universal joints 22 and 24. The first end portion 66 of the connecting rods 26 and 28 is angled downwardly toward the surface 40 of the table 12 and the end thereof is attached to the pen holder 30. This design of the rods 26 and 28 eliminates the need of providing an elevated writing surface on the table 12.

The U-shaped second end portion 68 by its design acts as a counterweight in the balancing of the pen 32 on the work sheet 38. Attached to the U-shaped second end portion 68 of the connecting rods 26 and 28 is an adjustable counterweight 80 which provides for a fine adjustment of weight on the tip of the pen 32. The adjustable counterweight 80 is adjustable along the lower side of the U-shaped second end portion 68. By moving the adjustable counterweight 80 to a position 82 shown in dotted lines, additional weight is put on the tip of the pen 32 whereby the design is drawn with heavier lines. By moving the adjustable counterweight 80 to a position 84 shown in dotted lines, weight is taken off the tip of the pen 32 and lighter lines are drawn by the pen 32. Also by taking weight off the tip of the pen, friction is reduced between the pen 32 and working sheet 38 and the drawing time of the toy 10 is extended.

Figure 2:
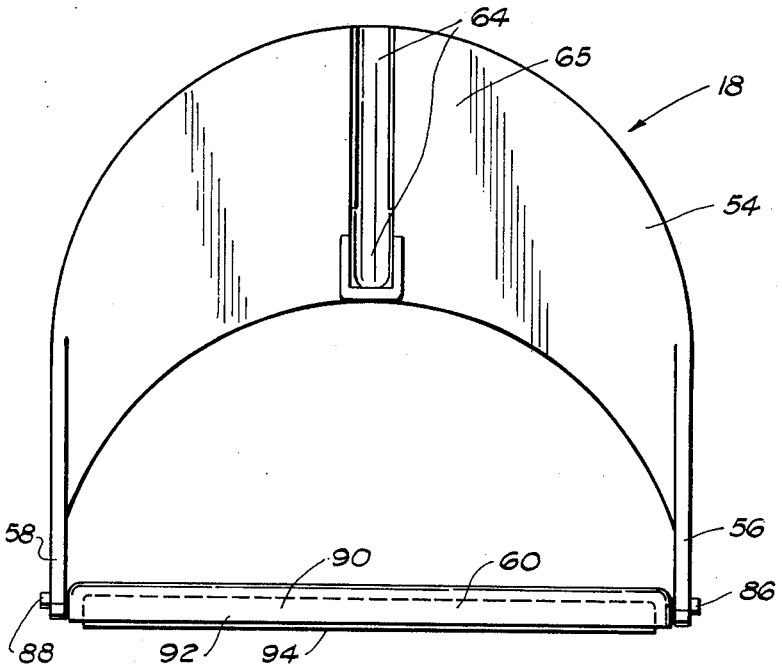
FIG. 2 is a front view of the stirrup.

In FIG. 2 a front view of the first stirrup 18 is illustrated. The description of the first stirrup 18 would be the same for the second stirrup 20. The first stirrup 18 includes the center portion 65 with the L-shaped channel 64 integrally formed therein. The stirrup 18 includes the end portions 56 and 58 pivotally attached to base arms 86 and 88 which are attached to the sides of the stirrup base 60. The base 60 includes a cavity 90 in its bottom portion and shown in dotted lines. Inserted and secured in the cavity 90 is an enlongated rubber grip 92 having a portion 94 extending outwardly from the stirrup base 60. The portion 94 grips the surface 40 of the table 12 and holds the stirrup 18 in place while the toy 10 is in operation.

Figure 3:
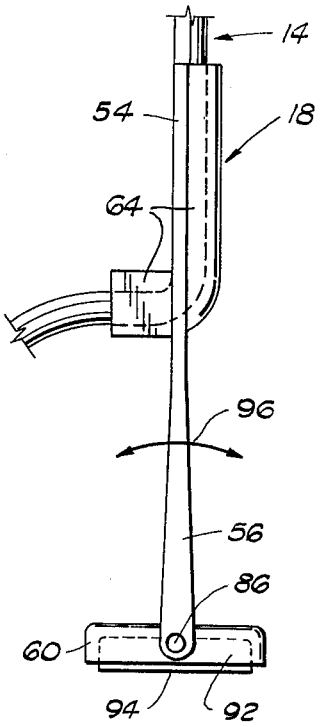
FIG. 3 is side view of the stirrup.

FIG. 3 is a side view of the stirrup 18 showing a section of the pendulum rod 14 received in the L-shaped channel 64 and secured therein. The arrow 96 indicates the direction the stirrup frame 54 and pendulum rod 14 pivot about the arms 86 and 88 attached to the stirrup base 60.

Figure 4:
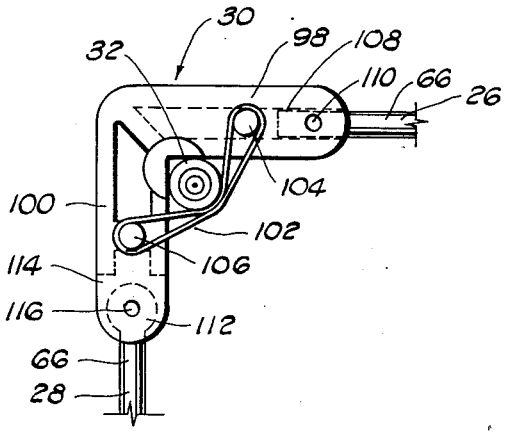
FIG. 4 is a bottom view of the pen holder.

FIG. 4 is a top view of the pen holder 30. The pen holder 30 includes two intersecting arms 98 and 100. The pen 32 is held in place against the intersection of the arms 98 and 100 by a rubber band 102 or the like. The rubber band 102 is held on the pen holder 30 by a post 104 mounted on arm 98 and a post 106 mounted on arm 100. The end portion 66 of the first connecting rod 26 is rigidly secured inside a slot 108 in the end of the arm 98. The end portion 66 is held in place in the slot 98 by a pin 110. The end portion 66 of the second connecting rod 28 is rotatably attached inside a slot 114 in the arm 100. A bushing 112 is integrally attached tc the end portion 66 and pivots on a pin 116 inserted through the slot 114.

Figure 5:
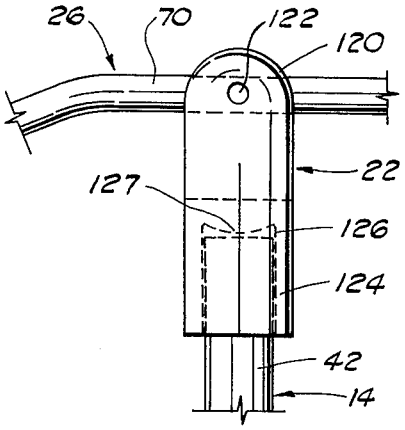
FIG. 5 is a side view of the universal joint.

FIG. 5 is a side view of the first universal joint 22. The description of the universal joint 22 would be the same for the second universal joint 24. Pivotally attached to a top portion 120 of the first universal joint 22 is the center portion 70 of the first connecting rod 26 and held in place by a pin 122. The first universal joint 22 further includes a bottom portion 124 which includes a bore 126 therein for slidably receiving the first end portion 42 of the pendulum rod 14. The universal joint 22 pivots about the first end portion 42 in the bore 126. The bottom of the bore 126 includes a convex surface 127 which provides a minimum contact surface against the top of the first end portion 42 as the universal joint 22 pivots thereon.

Figure 6:
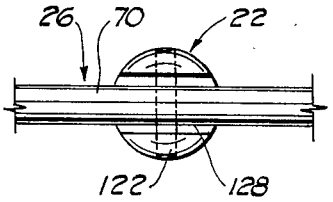
FIG. 6 is a top view of the universal joint.

In FIG. 6 a top view of the universal joint 22 is seen. In this view a slot 128 can be seen for receiving the first connecting rod 26 therein. Shown in dotted lines is the pin 122 for holding the connecting rod 26 in place and pivoting thereon.

FIG. 7 is a perspective view of the adjustable counterweight 80. The counterweight includes an aperture 130 for receiving the second end portion 68 of the connecting rods 26 and 28 therein. Across the surface of the inner circumference of the counterweight 80 is an upstanding rib 132. The rib 132 is compressed when the second end portion 68 is inserted into the aperture 130. The rib 132 provides a press fit against the sides of the second end portion 68 as the adjustable counterweight 80 is moved back and forth on the second end portion 68 and prevents the counterweight 80 from sliding freely during the operation of the toy 10.

In operation the pendulum toy 10 is assembled and the pen 32 is secured to the pen holder 30. The first connecting rod 26 and the second connecting rod 28 are positioned approximately 90° to each other along with the stirrups 18 and 20 and attached pendulum rods 14 and 16. While the 90° position is desirable it is understood that this angle can be greater or less than 90° and the object of the toy 10 can still be achieved. The pen holder 30 is grasped and the pen 32 is held slightly above the work sheet 38 positioned on top of the table 12. By moving the pen 32 and pen holder 30 to one side of the work sheet 38 the first pendulum rod 14 and second pendulum rod 16 are pivoted on the first stirrup 18 and second stirrup 20. When the pen holder 30 is released the first pendulum rod 14 and second pendulum rod 16 with the weighted balls 50 attached thereto begin to pivot in a vertical plane perpendicular to each other and to the plane of the surface 40 of the table 12. As the pendulum rods 14 and 16 pivot in a vertical plane the first and second connecting rods 26 and 28 attached to the first and second pendulum rods 14 and 16 by the first and second universal joints 22 and 24 pivot in a horizontal plane. The pivoting of the connecting rods 26 and 28 in a horizontal plane provides the horizontal movement to the pen 32 attached to the pen holder 30 for drawing various designs on the work sheet 38. The length of the designs can be shortened or lengthened by a combination of adjusting the weighted balls 50 on the end portions 44 of the first and second pendulum rods 14 and 16 and how far the pen 32 is positioned to one side of the work sheet 38 when the toy 10 is started in motion. Also as mentioned above the weight on the pen 32 can be adjusted making either heavy or light lines by moving the adjustable counterweight 80 along the second end portion 68 of the connecting rods 26 and 28.

Changes may be made in the combination and arrangement of the elements as heretofore set forth in the specification and shown in the drawings. It is understood that the changes may be made in the embodiments disclosed without departing from the spirit or scope of the invention as defined in the following claims.

I claim:

1. A pendulum toy using a marking instrument for making a variety of designs on a work sheet positioned on a planar horizontal surface of a table, the toy comprising:

a first and second pendulum rod pivot means positioned on the horizontal surface of the table:

a first and second pendulum rod pivotally supported on said first and second pivot means;

said first and second pendulum rods having a vertically positioned first end portion, a vertically positioned second end portion, and a center portion, the first end portion positioned above said horizontal surface of the table and seated in said pivot means, the second end portion positioned below the horizontal surface of the table, said center portion connecting said first and second end portions and therefore extending plane; an edge of said planar surface with enough clearance to allow pivoting of said pendulum rods in a vertical plane:

a first and second pendulum weight attached to the second end portions of said first and second pendulum rods substantially directly below said pendulum rod pivot means;

a first connecting rod pivotally attached to the first end portion of said first pendulum rod;

a second connecting rod pivotally attached to the first end portion of said second pendulum rod;

a pen holder attached to said first and second connecting rods, said pen holder holding a pen for drawing designs on the work sheet.

2. The toy as described in claim 1 wherein the first and second pendulum weights are adjustable on the second end portion of the pendulum rods so that the swing of the pendulum arm can be lengthened or shortened by adjusting the weight thereon.

3. The toy as described in claim 1 wherein said first and second pivot means is a stirrup having a U-shaped stirrup frame attached to said pendulum rods, the ends of the U-shaped stirrup pivotally attached to a stirrup base, the base disposed on top of the table and adjacent the edge thereof, said stirrups pivoting said first and second pendulum rods in a vertical plane perpendicular to the horizontal plane of the table.

4. The toy as described in claim 3 wherein a bottom portion of the stirrup base includes grip means disposed against the top of the table for gripping the surface of the table to prevent said stirrups from moving on the surface of the table while the toy is in operation.

5. The toy as described in claim 1 wherein the pivotal attachment of said first and second connecting rods to said first and second pendulum rods includes a first and second universal joint pivotally attached to the first end portion of said pendulum rods and said connecting rods, said connecting rods balanced horizontally on said universal joints and pivotally attached thereto so that as the pendulum rods pivot in a vertical plane, said connecting rods pivot in a horizontal plane parallel to the horizontal plane of the table.

6. The toy as described in claim 5 wherein said first and second connecting rods include a first end portion, a second end portion, and a center portion, the first end portion attached to said pen holder, the center portion pivotally attached to said universal joints, and the second end portion having an adjustable counterweight mounted thereon for balancing the weight applied to the writing tip of the pen.

7. The toy as described in claim 6 wherein said pen holder includes two intersecting arms, the end portion of one arm rigidly attached to the first end portion of said first connecting rod, the end portion of the other arm of said pen holder pivotally attached to the first end portion of connecting rod, the pen secured to the pen holder at the intersection of the arms.

8. A pendulum toy using a marking instrument for making a variety of designs on a work sheet positioned on a horizontal top of a table, the toy comprising:

a first and second stirrup, said stirrup having a U-shaped stirrup frame, the ends of the U-shaped stirrup frame pivotally attached to a stirrup base, the stirrup base disposed on top of the table and adjacent the edge thereof;

a first and second pendulum rod having a vertically positioned first end portion, a vertically positioned second end portion, and an annular shaped center portion adjacent the edge of the table and disposed therearound with enough clearance to allow pivoting of said pendulum rods in a vertical plane, the first end portion positioned above the edge of the table, the second end portion positioned below the edge of the table, a portion of the first end portion attached to said stirrup frame, said first and second pendulum rods pivoted on said stirrups in a vertical plane perpendicular to the horizontal plane of the table;

a first and second pendulum weight attached to the second end portion of said first and second pendulum rods and positioned substantially directly below said first and second stirrups;

a first and second universal joint pivotally attached to the first end portion of said first and second pendulum rods;

a first and second connecting rod horizontally balanced on said first and second universal joint and pivotally attached thereto, said connecting rods coacting with the movement of said pendulum rods and pivoting in a horizontal plane parallel to the horizontal plane of the table; and a pen holder attached to said first and second connecting rods, said pen holder holding a pen for drawing designs on the work sheet.

9. The toy as described in claim 8 wherein, said first and second connecting rods included a first end portion, a second end portion, and a center portion, the first end portion attached to said pen holder, the center portion pivotally attached to said universal joints, and the second end portion having an adjustable counterweight mounted thereon for balancing the weight applied to the writing tip of the pen.

10. The toy as described in claim 9 wherein, the second end portion of said first and second connecting rods is U-shaped, the U-shaped second end portion being a counterweight and the adjustable counterweight being an additional counterweight for the fine adjustment of the balanced weight applied to the writing tip of the pen.

11. The toy as described in claim 9 wherein, the first end portion of said first and second connecting rods is inclined downward toward the top of the table, the end of the inclined first end portion attached to said pen holder, the inclined first end portion eliminating the need of providing an elevated writing surface for the work sheet on the table.

* * * * *

UNITED STATES PATENT AND TRADEMARK OFFICE

CERTIFICATE OF CORRECTION

PATENT NO. : 3,977,085

DATED : August 31, 1976

INVENTOR(S) : Robert L. Sandifer

It is certified that error appears in the above-identified patent and that said Letters Patent are hereby corrected as shown below:

Claim 1, column 5, line 21, delete "plane;" and insert therefore --- around ---.

Signed and Sealed this

Ninth Day of November 1976

[SEAL]

*Attest:*

RUTH C. MASON
*Attesting Officer*

C. MARSHALL DANN
*Commissioner of Patents and Trademarks*